US006785503B2

(12) United States Patent
Kuo et al.

(10) Patent No.: US 6,785,503 B2
(45) Date of Patent: Aug. 31, 2004

(54) STRIPPER FINGERS AND ROLLER ASSEMBLY FOR A FUSER IN A PRINTING APPARATUS

(75) Inventors: Youti Kuo, Penfield, NY (US); Mark Stevens, Henrietta, NY (US); Paul M. Fromm, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/263,488

(22) Filed: Oct. 2, 2002

(65) Prior Publication Data

US 2004/0067079 A1 Apr. 8, 2004

(51) Int. Cl.[7] ..... G03G 15/20
(52) U.S. Cl. ..... 399/323
(58) Field of Search ..... 399/322, 323, 399/22, 399, 357, 320, 398; 271/311, 312, 313, 900; 492/46, 50, 56; 219/216

(56) References Cited

U.S. PATENT DOCUMENTS 3,918,702 A * 11/1975 Mihalik et al. ..... 271/311
4,035,140 A * 7/1977 Tsuda et al. ..... 432/60
4,062,534 A 12/1977 Sasahara ..... 271/174
4,261,560 A * 4/1981 Yanagawa et al. ..... 271/308
4,387,981 A * 6/1983 Cormier ..... 399/399
4,401,382 A * 8/1983 Minejima et al. ..... 399/399
4,627,609 A * 12/1986 Hofer ..... 271/311
4,761,667 A * 8/1988 Miyai et al. ..... 399/113
5,517,292 A * 5/1996 Yajima et al. ..... 399/323
5,623,720 A * 4/1997 Howe et al. ..... 399/323
5,822,668 A 10/1998 Fromm et al. ..... 399/323
6,205,316 B1 * 3/2001 Iida ..... 399/323
6,259,881 B1 * 7/2001 Nakamura ..... 399/323
6,490,428 B1 * 12/2002 Fromm et al. ..... 399/323

FOREIGN PATENT DOCUMENTS

JP 56051766 A * 5/1981 ..... G03G/15/20
JP 60076781 A * 5/1985 ..... G03G/15/20

* cited by examiner

*Primary Examiner*—Robert Beatty
(74) *Attorney, Agent, or Firm*—Lloyd F. Bean

(57) ABSTRACT

In a fuser for xerographic printing, stripper fingers remove the print sheet from a fuser roll. The stripper finger having a tip for stripping a lead edge of a sheet from the fuser roll. A roller assembly, positioned adjacent to the stripper finger; for engaging the lead edge of a sheet and lifting the sheet from further contact with the tip after the tip of the stripper finger strips the lead edge of the sheet from the fuser roll. The roller assemlby is removably mounted by using a snap-on mounting structure.

7 Claims, 6 Drawing Sheets

STRIPPER FINGERS AND ROLLER ASSEMBLY FOR A FUSER IN A PRINTING APPARATUS

FIELD OF THE INVENTION

The present invention relates to stripper fingers and associated rollers used with a fuser, such as for xerographic printers.

BACKGROUND OF THE INVENTION

In xerographic or electrostatographic printers commonly in use today, a charge-retentive member is charged to a uniform potential and thereafter exposed to a light image of an original document to be reproduced. The exposure discharges the charge-retentive surface in exposed or background areas and creates an electrostatic latent image on the member which corresponds to the image areas contained within the original document. Subsequently, the electrostatic latent image on the charge-retentive surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the charge-retentive area to form a powder image on the charge-retentive area. This image is subsequently transferred to a sheet, such as copy paper, to which it is permanently affixed by heating or by the application of pressure. Following transfer of the toner image to the sheet, the charge-retentive member is cleaned of any residual toner that may remain thereon in preparation for the next imaging cycle.

One approach to fixing the toner image is by applying heat and pressure by passing the sheet containing the unfused toner images between a pair of opposed roller members at least one of which is internally heated. During this procedure, the temperature of the toner material is elevated to a temperature at which the toner material coalesces and becomes tacky. This heating causes the toner to flow to some extent into the fibers or pores of the sheet. Thereafter, as the toner material cools, solidification of the toner material causes the toner material to become bonded to the support member. Typical of such fusing devices are two roll systems wherein the fuser roll is coated with an adhesive material such as a silicone rubber or other low surface energy elastomers.

During the fusing process and despite the use of low surface energy materials as the fuser roll surface, there is a tendency for the print substrate to remain tacked to the fuser roll after passing through the nip between the fuser roll and the pressure roll. When this happens, the tacked print substrate does not follow the normal substrate path but rather continues in an arcuate path around the fuser roll, eventually resulting in a paper jam which will require operator involvement to remove the jammed paper before any subsequent imaging cycle can proceed. As a result it has been common practice to ensure that the print substrate is stripped from the fuser roll downstream of the fuser nip. One approach is the use of a plurality of stripper fingers placed in contact with the fuser roll to strip the print substrate from the fuser roll. While satisfactory in many respects, this suffers from difficulties with respect to both fuser roll life and print quality. To ensure an acceptable level of stripping it is frequently necessary to load such a stripper finger against the fuser roll with such a force and at such an attack angle that there is a tendency to peel the silicone rubber off the fuser roll, thereby damaging the roll to such an extent that it can no longer function as a fuser roll. Further, there is a tendency for the stripper fingers to leave fingermarks on the sheets.

SUMMARY OF THE INVENTION

There is provided a fuser for xerographic printing, stripper fingers remove the print sheet from a fuser roll. The stripper finger having a tip for stripping a lead edge of a sheet from said fuser roll. A roller assembly, positioned adjacent to said stripper finger; for engaging said lead edge of a sheet and lifting the sheet from further contact with said tip after said tip of said stripper finger strips said lead edge of said sheet from said fuser roll.

DETAILED DESCRIPTION OF THE INVENTION

Figure 1:
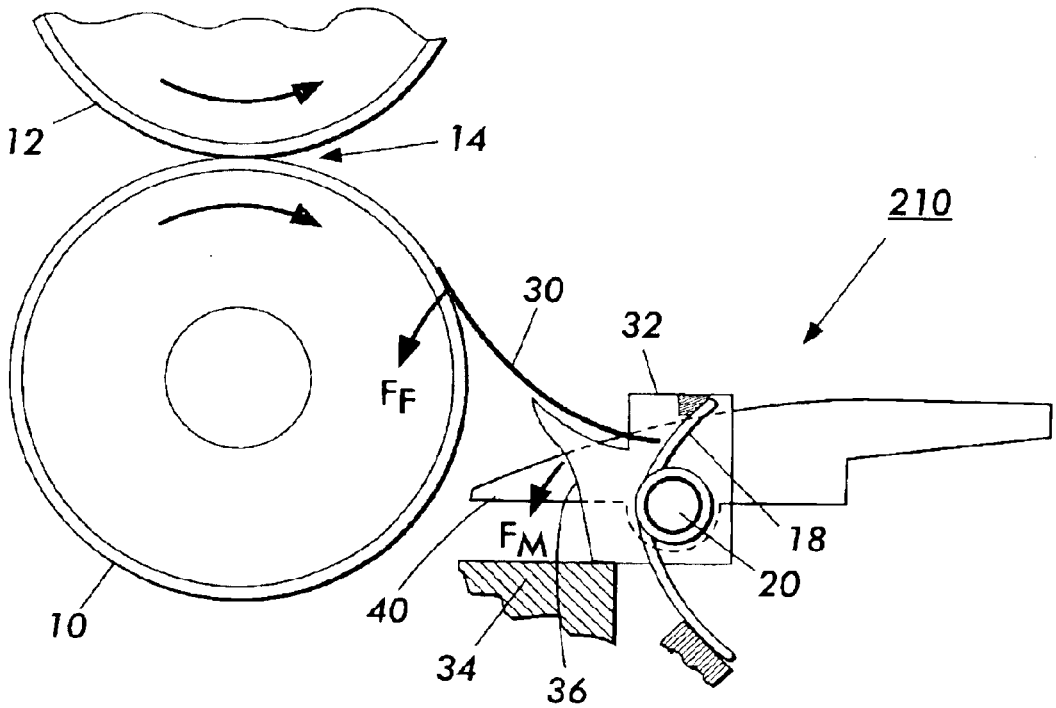
FIG. 1 PRIOR ART
FIG. 1 is an elevational view of a stripper finger according to the prior art, interacting with a fuser roll.

FIG. 1 is an elevational view of a stripper finger assembly as known in the prior art, and as such is similar in general design to the stripper fingers shown in U.S. Pat. Nos. 4,062,534 and 5,822,668. Typical in any xerographic fusing apparatus is a fuser roll, here indicated as 10, which contacts a pressure roll 12 along a longitude thereof, forming a nip 14 therebetween. As is familiar in the art, print sheets, such as created by xerographic printing, are pulled through the nip by the rotation of rolls 10, 12. Typically the freshly-fused marking material, such as toner, on the print sheet, which is facing down in the view of FIG. 1, may cause the sheet to stick to the surface of fuser roll 10 even after passing through nip 14. To remove the sheet from the surface of fuser roll 10 as the sheet is drawn through nip 14, it is typical to use one or more springably-urged stripper fingers such as 30. Each stripper finger 30 contacts the fuser roll 10 near nip 14 and functions to lift sheets off the roll 10 as the sheet passes thereover.

According to the particular prior-art example shown in FIG. 1, a stripper finger 30 is a substantially rigid member, having by itself essentially no spring constant associated therewith. The spring force $F_S$ with which stripper finger 30 is urged against the roll 10 is provided exclusively by a spring 18 (which is here in the form of a torsion spring, but could be in other forms as well). The stripper finger 30 is thus rotatably mounted on axle 20.

Selection of a value of $F_S$, which basically relates to a spring constant associated with spring 18, for satisfactory performance must balance at least two competing interests. Very generally, a higher force $F_S$ will be more effective in peeling off the sticking sheet from the surface of roll 10. However, too high a force $F_S$ can damage the surface of roll 10, and thus selection of a value of $F_S$ would be intimately related to, for instance, the deformability and therefore the material selection of roll 10. Also, a lighter force $F_S$ will be more effective in allowing the stripper finger 30 to rotate around axle 20 away from the roll 10 in case of a paper jam around stripper finger 30. Often an optimal $F_S$ for purposes of efficient stripping will be at cross-purposes with a value of $F_S$ for jam clearance and avoidance.

Figure 2:
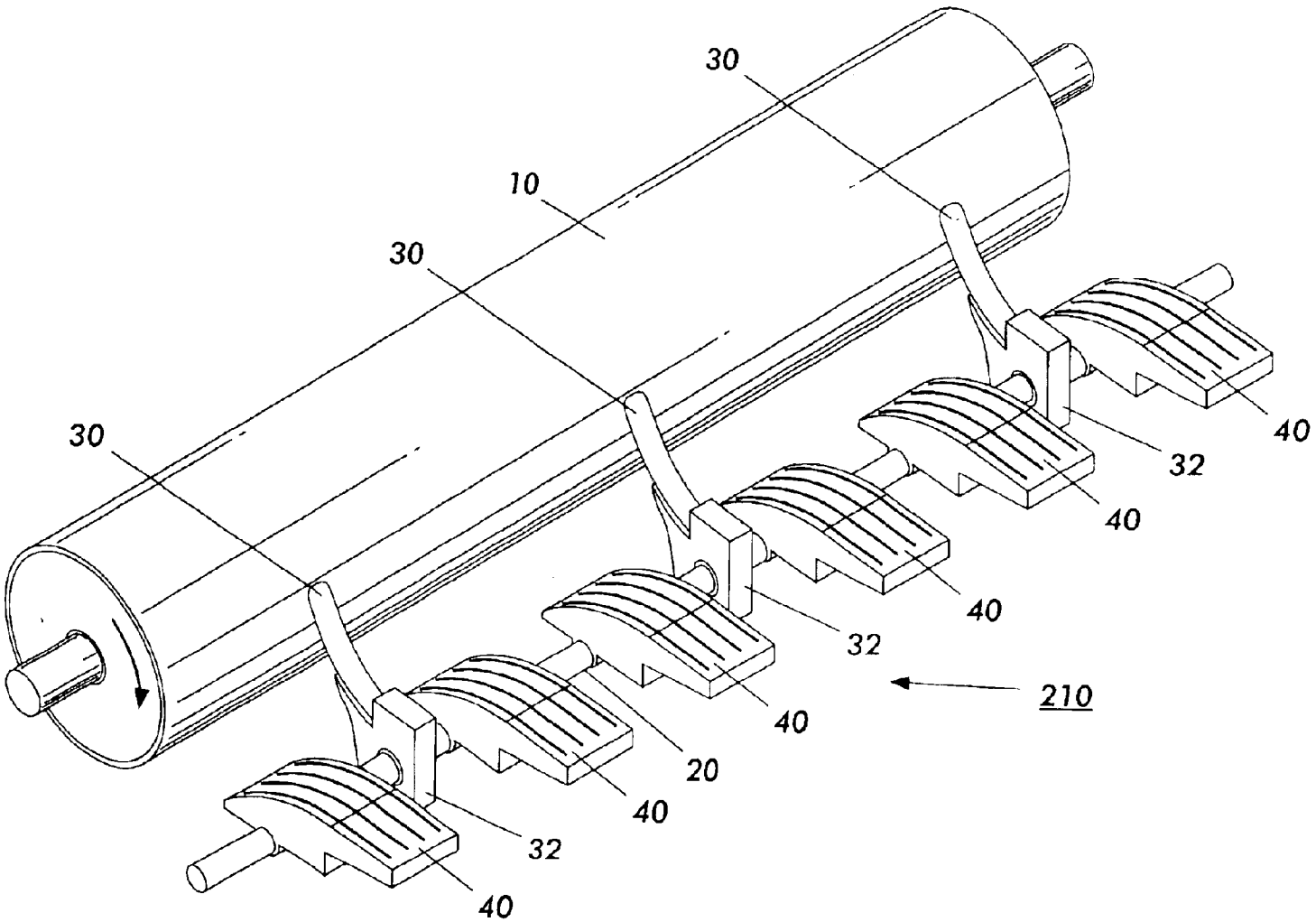
FIG. 2 PRIOR ART
FIG. 2 is a perspective view of an assembly of stripper fingers, according to the prior art.

FIG. 2 is a perspective view of stripper finger assembly 210 including a plurality of stripper fingers 30 and associated mounts 32, as in FIG. 2. In one embodiment, each of a plurality of such mounts 32 along a roll 10 are movable independently of each other. As can be seen, there is further provided, on either side of (or, more broadly, adjacent to) each mount 32, what is here called a "baffle" and which is indicated in as 40. The baffles 40 provide surfaces against which mis-stripped papers crumple.

A stripper finger mark, in a broad sense, is caused by the sliding of the imaged side of a fused print on a high contact point of a stationary surface of the stripper finger assembly. A high contact point can be the tip of a stripper finger or a rib of the assembly. A sheet exiting from the fuser nip can exert a significant amount of contact force to create scratching marks. However, it is difficult to avoid such abrasion contacts in view of the wide range of papers with a variety of image types encountered in low to high humidity conditions.

An air knife approach is effective in avoiding abrasion contacts, but it is expensive. A retractable stripper finger approach changes contact points but still expose stationary contact areas that potentially cause smudges or non-uniform gloss on fused images. An alternative approach is providing rotational surfaces at the strategic high points of contact, which also deflect the paper path to safe contact areas where less contact forces are exerted and the fused images are more cooled off.

Figure 3:
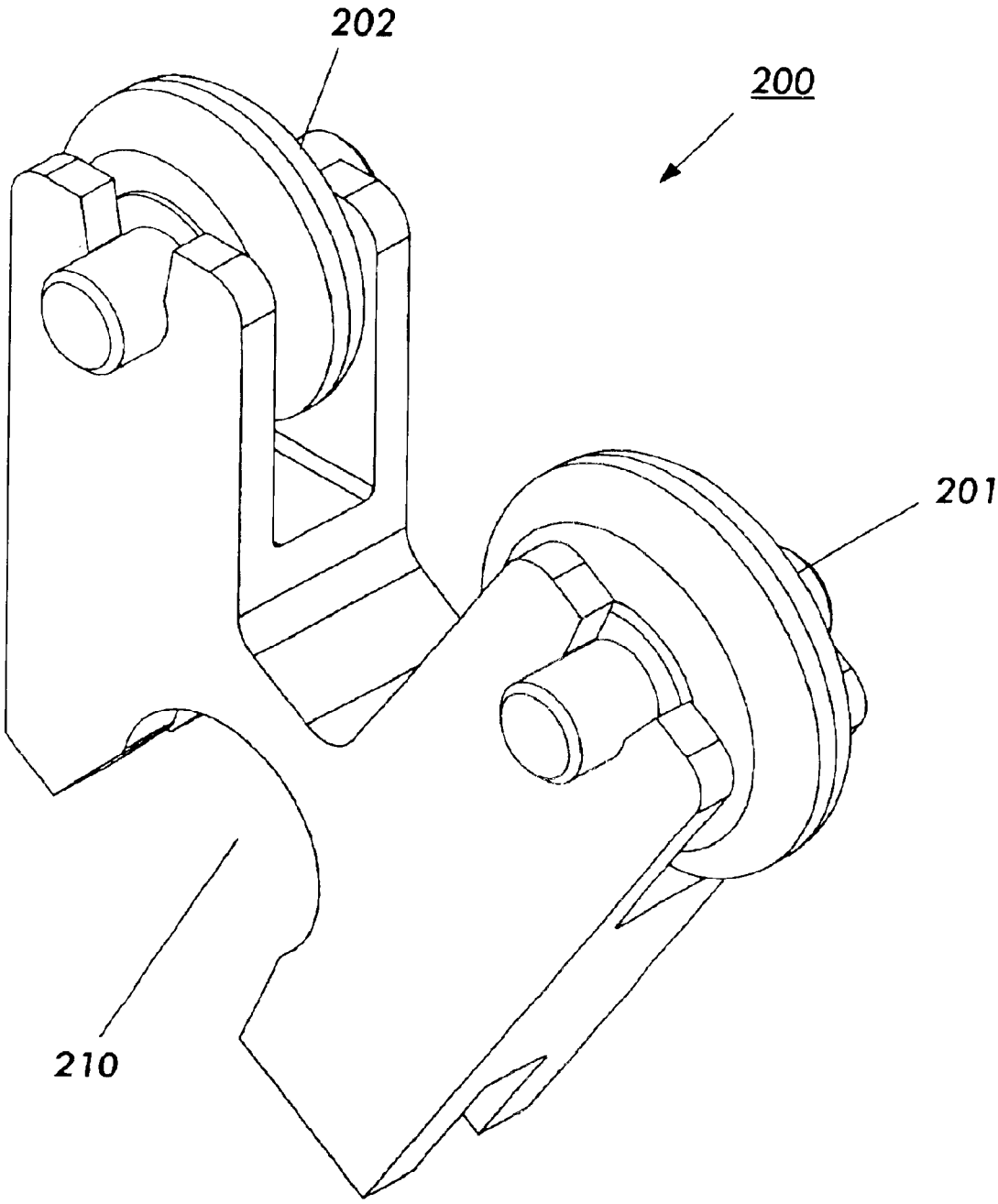
FIGS. 3 and 4 are perspective views of a roller assembly, according to the present invention.
Figure 4:
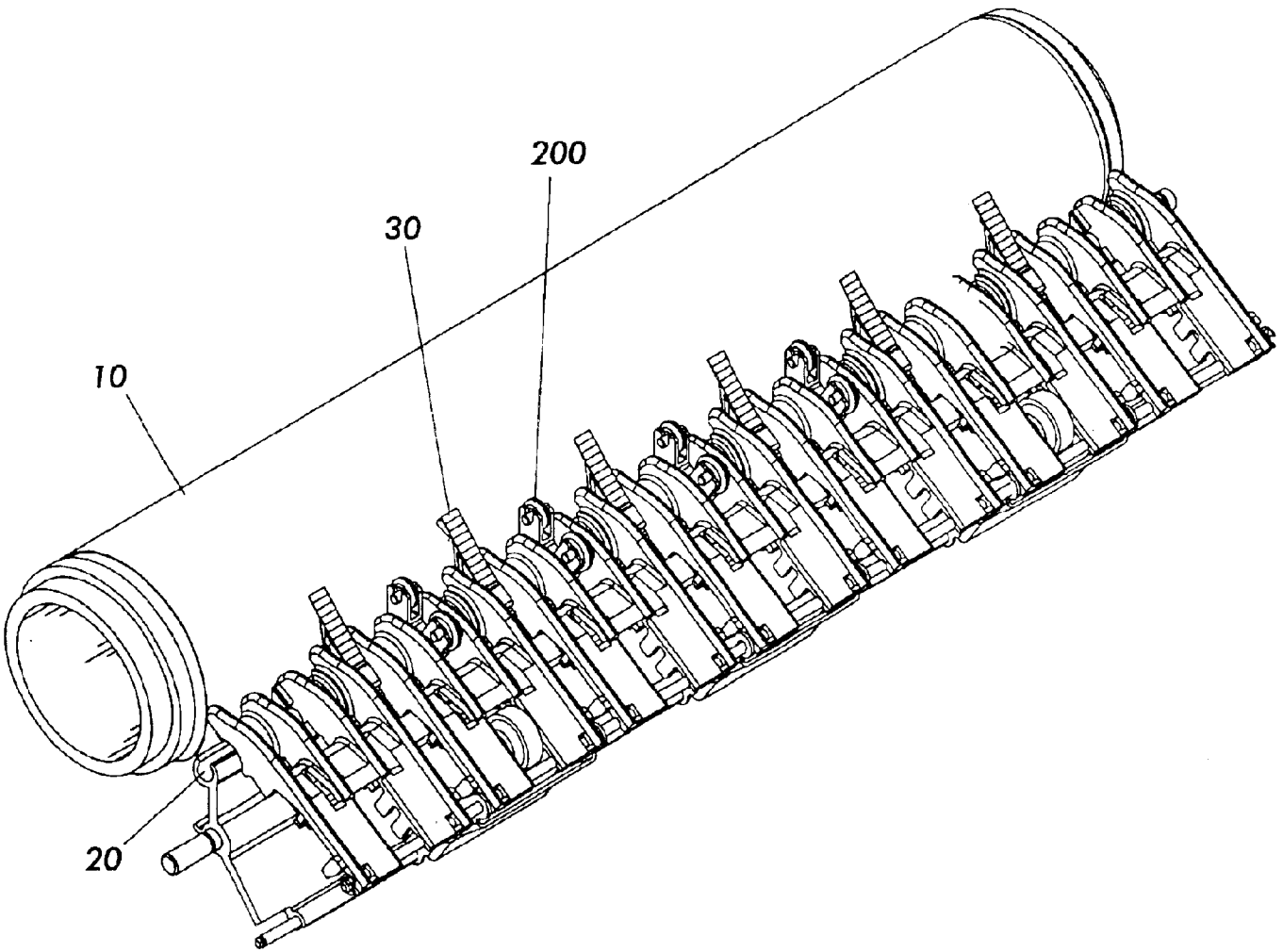

FIGS. 3 and 4 are perspective views of a roller assembly 200, according to the present invention. This present invention provides a means of eliminating stripper finger marks in the stripper fingers assembly by mounting snap-on portion 210 of roller assembly 200 onto shaft 20. Rotary wheels 201 and 202 are postioned in the post-finger ribs portion of the assembly for reducing the abrading force on the fused images. The snap-on rotary wheels can be located in one or multiple locations down stream of the stripper fingers for increasing the latitude for wide range of papers, image types and humidity conditions.

FIG. 4 shows a fuser roll having a set of stripper fingers mounted on a common shaft 20. Each pair of idle rolls 201 and 202 (or free-rotating wheels) positioned between stripper fingers is individually mounted on the shaft of stripper fingers (or rib walls) with a snap-on support 210. Snap-on support 210 is a semi-circular recess of the support is for press-fit mounting on the stripper finger shaft. The idle rolls are free to rotate driven by the contact force of the exiting fused paper.

In operation, the surfaces of the idle rolls are protruding above the ribs of the stripper finger assembly. The first set of idle rolls most closest to the stripper finger tips is for lifting the lead edge of the fused sheet and the second set of idle rolls downstream of the paper path is for keeping the sheet from contacting stationary rib surfaces away from the stripper finger tips. The idle rolls have low moment of inertia and free to rotate. Their diameters, positions, and heights of protrusion are positioned to avoid the stubbing of the lead edge of a sheet exiting from the fuser nip.

The surface of the idle rolls may be optionally coated with non-stick material for minimizing contamination from toners. The location of the first set of idle rolls are positioned as close to the finger tips as possible for minimizing the exposed finger areas. If necessary, a third idle roll can be added to the snap-on support. In a three-roll configuration, a smaller idle roll can be positioned most close to the finger tips to shorten the exposed finger areas.

Figure 5:
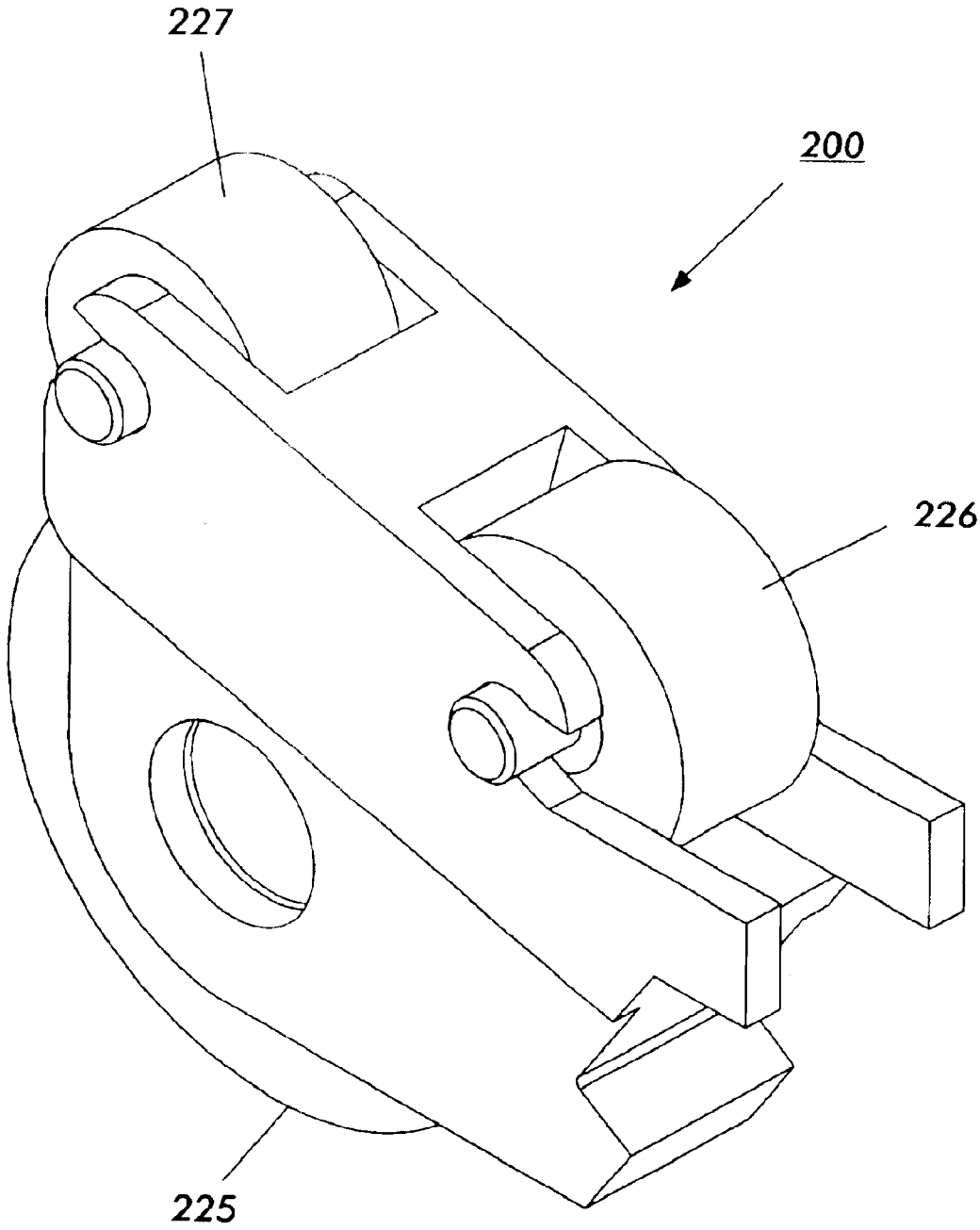
FIG. 5 is a perspective view of an assembly of stripper fingers and roller assembly, according to the present invention.

FIG. 5 illustrates another embodiment of the present invention, in this embodiment the rotational surfaces are part of active driving rollers. The active driving rollers are driven by intermediate rollers 225 which can be driven by the contact between the intermediate rollers or the fuser roll surface, or driven by a drive shaft which is engaged with the fuser drive system.

FIG. 5 shows a snap-on unit of three-rollers assembly. The first and the second active driving rollers 227 and 226 are driven by the contact with the third roller 225. The third roller is an intermediate roller, which is to be loaded and driven by the contact with a fuser roll. It has a deformable elastomer layer having high friction and temperature-resistant properties. The surfaces of the first and the second active driving rollers are protruding above the ribs of the stripper finger assembly. The first roller should be positioned as close to the stripper finger tip as possible to minimize potential marking near the lead edge of a paper, which is possible prior to the contact of the paper lead edge with the first roller. The first active driving roller lifts the lead edge of a fused sheet and the second active driving roller keeps the sheet from contacting stationary rib surfaces. The intermediate rollers are in contact with the fuser roll. A required drive force is achieved by the deformation of the elastomer surface as a result of a built-in interference between the intermediate roller and the fuser roll. The elastomer material can be a high temperature cellular foam or low to medium rubber having textured surface for high friction.

Figure 6:
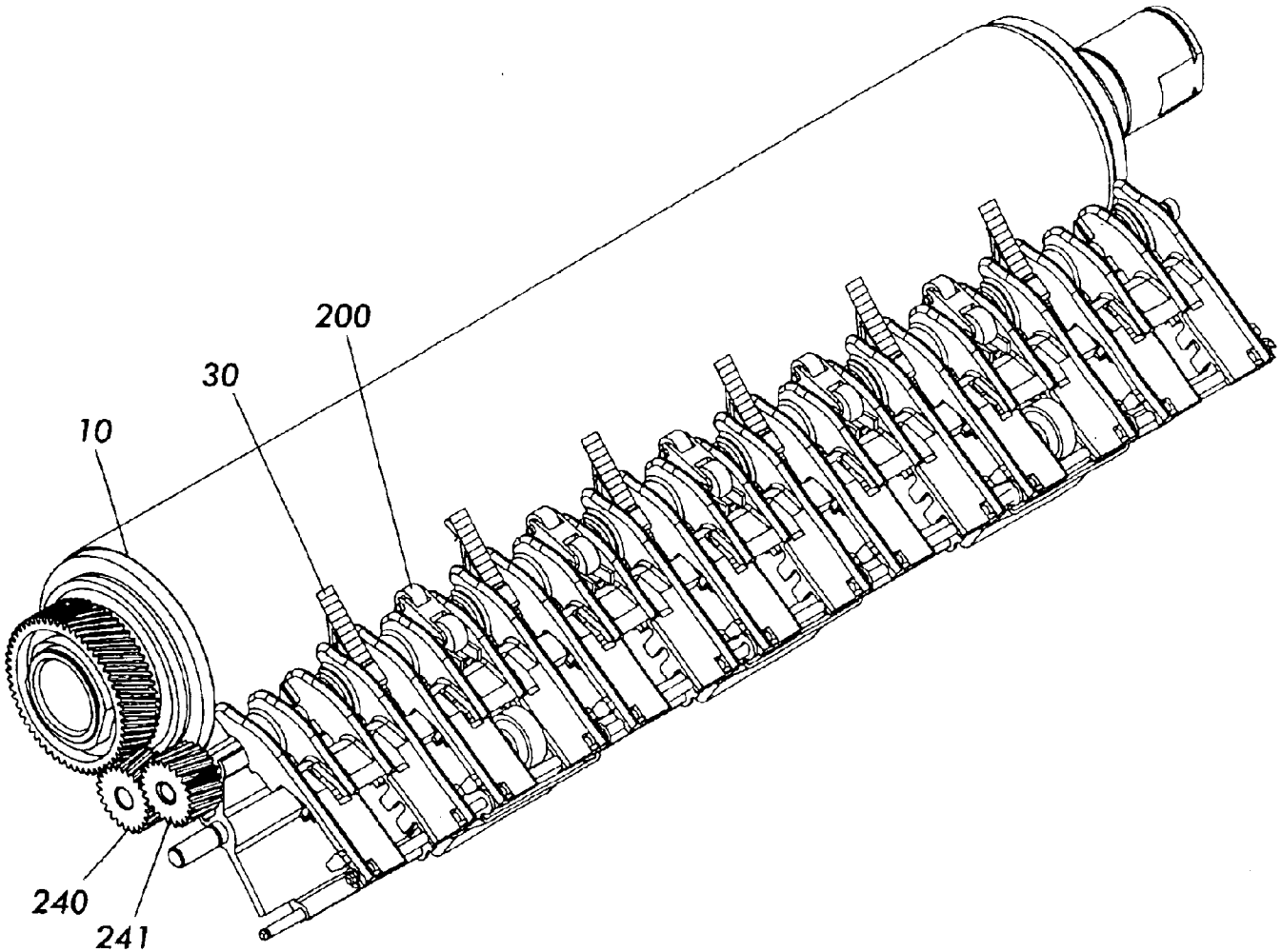
FIG. 6 is a perspective view of another embodiment of an assembly of stripper fingers and roller assembly, according to the present invention.

FIG. 6 illustrates active driving rollers which are driven by the fuser drive system through the intermediate rollers, which are not in contact with the fuser roll surface. The intermediate rollers (not shown) are mounted on the post-fingers drive shaft, which has gears 240 and 241 at one end engaged with the fuser drive system. For space savings, the post-fingers drive shaft may be the same as that of stripper fingers shaft. In that configuration sufficient clearance is provided between the stripper fingers and the rotating drive shaft such that the rotation of the drive shaft cannot rotate the stripper fingers. This design allows the drive shaft to be separate from the stripper fingers shaft.

While the invention has been described with reference to the structure disclosed, it is not confined to the details set forth, but is intended to cover such modifications or changes as may come within the scope of the following claims.

What is claimed is:

1. A fusing apparatus useful in printing, comprising:

a fuser roll;

a stripper finger having a tip for stripping a lead edge of a sheet from said fuser roll;

a roller assembly, positioned in a mounted position adjacent to said stripper finger; for engaging said lead edge of a sheet and lifting the sheet from further contact with said tip after said tip of said stripper finger strips said lead edge of said sheet from said fuser roll, said roller assembly being removable from said mounted position said roller assembly including a snap on mounting structure for holding said roller assembly adjacent to said stripper finger.

2. The apparatus of claim 1, wherein said roller assembly includes a first and second roller.

3. The apparatus of claim 2, wherein said roller assembly is passive driven by the lead edge of said sheet.

4. The apparatus of claim 1, wherein said roller assembly is actively driven by a drive means.

5. The apparatus of claim 4, wherein said drive means drives the contact surface of said roller assembly substantially at the same velocity of said sheet exiting the fuser roll.

6. The apparatus of claim 1, further comprising a baffle, the baffle defining a surface adjacent the stripper finger along a length of the fuser roll when the stripper finger is contacting the fuser roll.

7. The apparatus of claim 1, wherein said snap on mounting structure includes a shaft and a snap on portion partial enclosing said shaft.

* * * * *